US008443792B2

(12) United States Patent
Litzenberger

(10) Patent No.: US 8,443,792 B2
(45) Date of Patent: May 21, 2013

(54) PORTABLE CAMPFIRE CHIMNEY

(76) Inventor: Brad Litzenberger, Chilliwack (CA)

( * ) Notice: Subject to any disclaimer, the term of this patent is extended or adjusted under 35 U.S.C. 154(b) by 944 days.

(21) Appl. No.: 12/544,511

(22) Filed: Aug. 20, 2009

(65) Prior Publication Data

US 2011/0041828 A1 Feb. 24, 2011

(51) Int. Cl.
*F24B 3/00* (2006.01)

(52) U.S. Cl.
USPC ..... 126/29; 126/25 R; 126/9 B; 126/9 R; 126/59; 454/42

(58) Field of Classification Search
USPC ..... 126/29, 9 R, 1 D, 25 R, 25 B, 298, 126/500, 512, 540, 543, 544, 548, 555, 614, 126/19.5, 222, 1 R, 27, 59, 9 A, 506, 38, 126/48, 50, 92 R, 100, 212, 213, 215, 216, 126/218, 25; 110/239; 99/467; 454/42
See application file for complete search history.

(56) References Cited

U.S. PATENT DOCUMENTS

| | | | | | |
|---|---|---|---|---|---|
| 702,999 | A * | 6/1902 | Richards | 126/506 |
| 1,094,151 | A * | 4/1914 | Kemp | 126/9 R |
| 1,371,794 | A * | 3/1921 | Earl | 126/59 |
| 2,998,002 | A * | 8/1961 | Standig | 126/25 A |
| 3,455,291 | A * | 7/1969 | Glass | 126/506 |
| 4,489,706 | A * | 12/1984 | Hait | 126/9 R |
| 4,732,138 | A * | 3/1988 | Vos | 126/25 A |
| 5,203,316 | A * | 4/1993 | Pritchett | 126/29 |
| 2004/0020484 | A1 * | 2/2004 | Skidmore et al. | 126/25 R |
| 2006/0102163 | A1 * | 5/2006 | Sanders et al. | 126/30 |

* cited by examiner

*Primary Examiner* — Kang Hu
*Assistant Examiner* — Vivek Shirsat
(74) *Attorney, Agent, or Firm* — Gordon Thomson

(57) ABSTRACT

A campfire chimney for placement over a campfire to shield nearby persons from excessive heat, smoke and burning embers. The campfire has a base comprising at least for telescoping legs to adjust the height of the chimney over the fire. The chimney has a bottom conical section for placement over the fire and a tubular top section for exhausting products of combustion. The chimney can be disassembled and can be transported conveniently by a single individual.

4 Claims, 6 Drawing Sheets

FIG. 3A
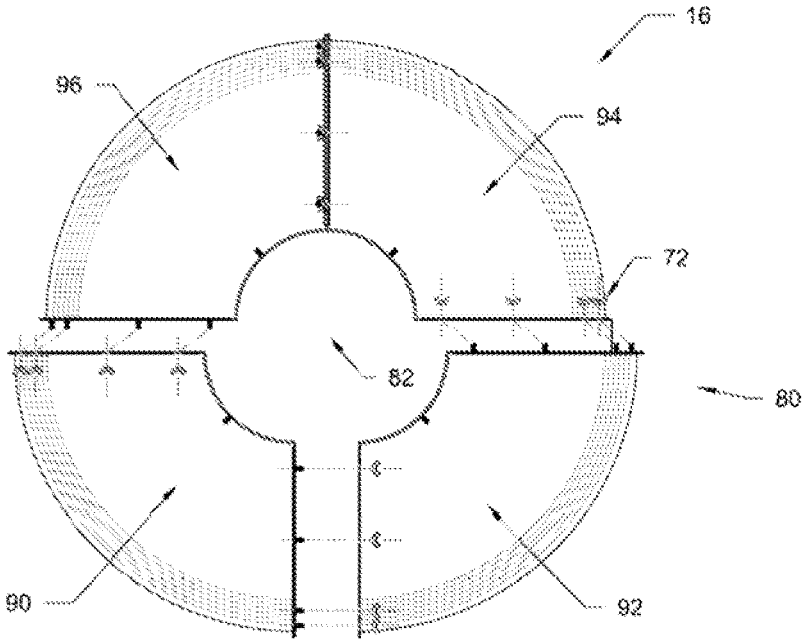
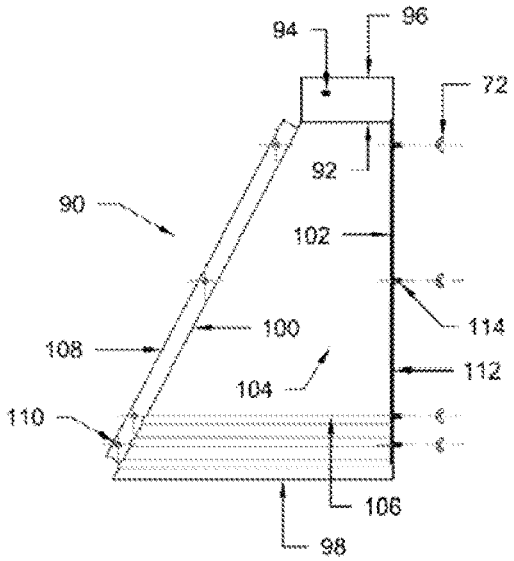
FIG. 3B

FIG. 4A
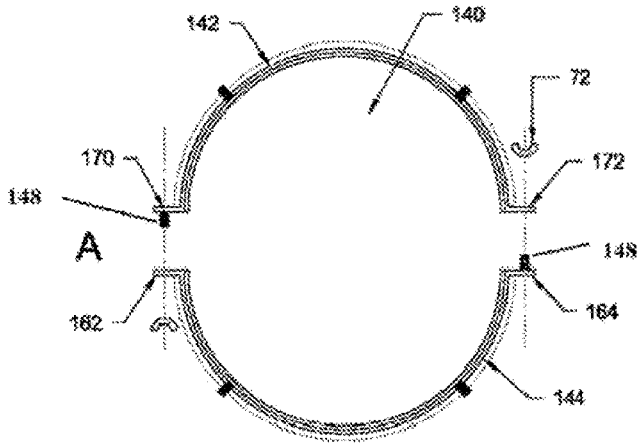
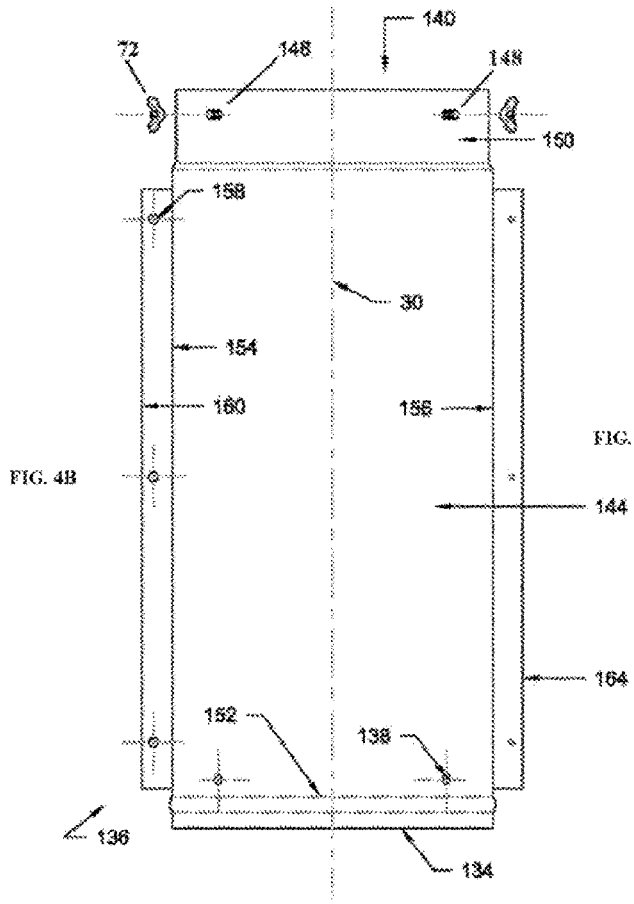
FIG. 4B
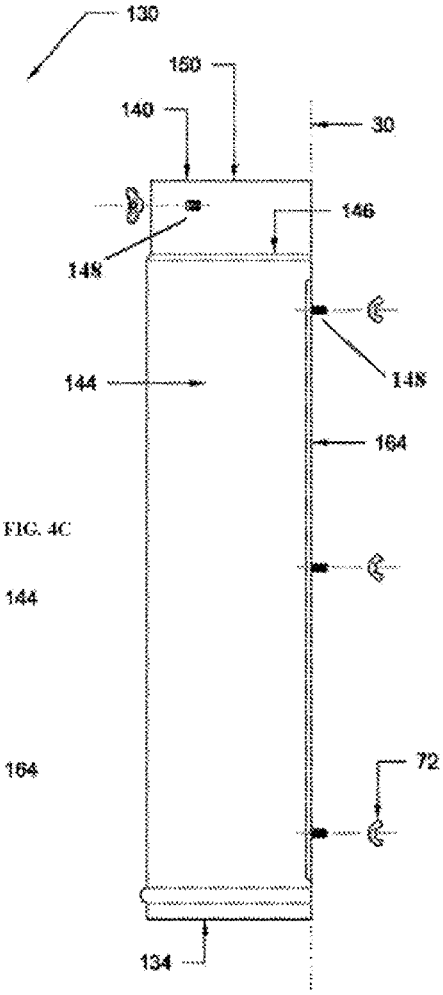
FIG. 4C

FIG. 6A
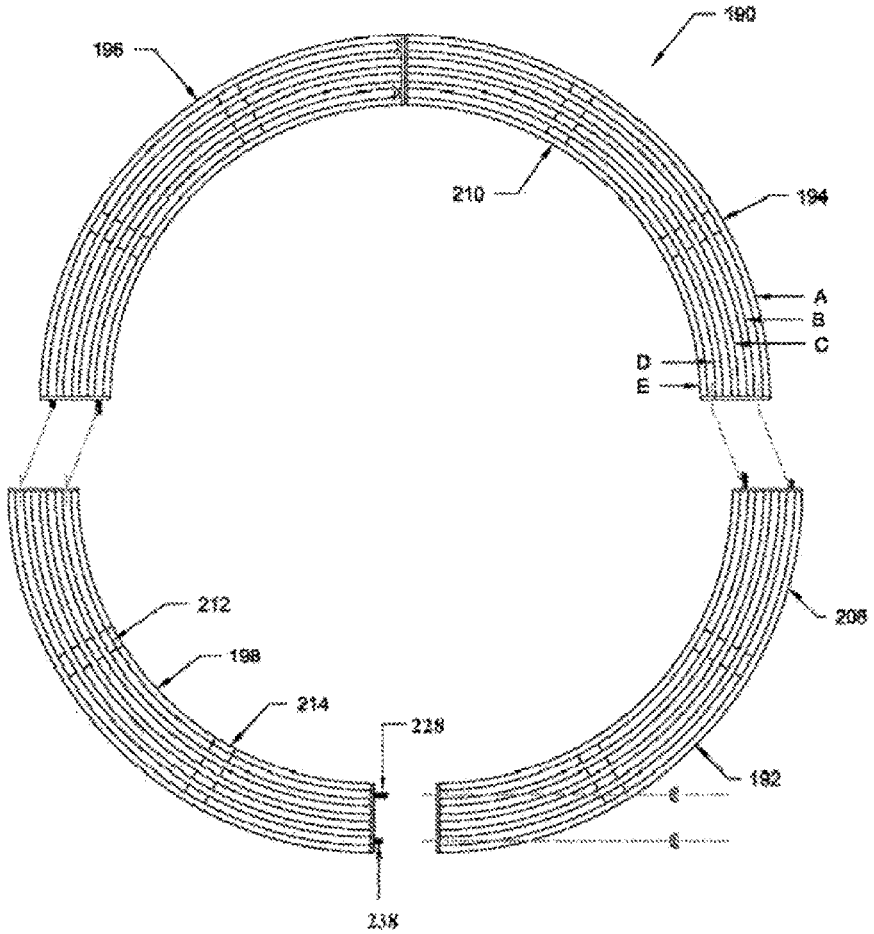
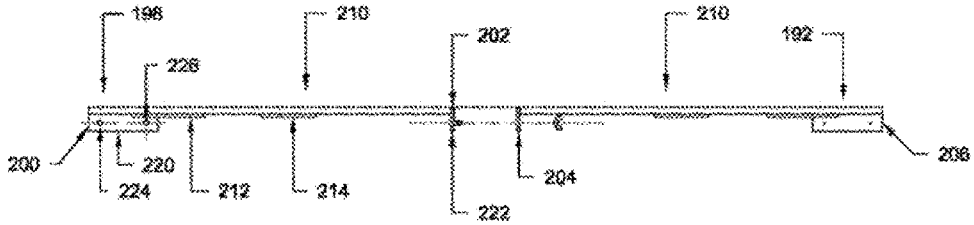
FIG. 6B

PORTABLE CAMPFIRE CHIMNEY

FIELD OF THE INVENTION

This invention relates to stoves and furnaces as well as ventilation means and particularly to a portable campfire chimney.

BACKGROUND OF THE INVENTION

Outdoor campfires are a North American ritual. However, they have hazards and many people are injured from burns due to proximity to the open fire, smoke and flying embers. As well, outdoor campfires are a well known source of forest fires. There have been many attempts at manufacturing devices that can form a barrier between people and the hazardous aspects of an outdoor fire while still providing the enjoyment from the visual, cooking and heating aspects of an outdoor fire. One such attempt is embodied in U.S. Pat. No. 4,875,462 CAMPFIRE SMOKESTACK by Armstrong et al. issued on Oct. 24, 1989. This patent discloses a plurality of nesting, hollow frustums stacked one-upon-the-other to form a conical smokestack. This patent sits low to the fire and obscures the blaze which is an enjoyable component of the outdoor campfire. As well, a door is provided for access to an interior camping grill and so there is still a potential for burn injuries.

Therefore, there is a continuing need for an apparatus that will offer further protection to persons proximate to an outdoor campfire while permitting those persons to enjoy the benefits there of.

SUMMARY OF THE INVENTION

To resolve the problems noted above, my invention provides for a portable campfire chimney comprising a supporting base comprised of at least four telescoping leg assemblies for supporting a frusto-conical body for placement over a campfire and creating a suitable draft for the fire and a tubular sectional body above the frusto-conical body for exhausting products of combustion. Optionally my invention can include a ring grill placed around the bottom portion of the frusta-conical body for placement of objects for heating.

The four leg assemblies are attached to the bottom of the frusto-conical body and they can be telescopically adjusted to provide a desired distance between the campfire and the bottom of the frusto-conical body.

The frusto-conical body is assembled from four sections. The tubular second body is assembled from two sections. The ring grill is assembled from four sections.

The invention is intended to be portable and can be carried by a single individual.

Further objects and advantages of my invention will become apparent from a consideration of the following drawings and detailed description.

BRIEF DESCRIPTION OF THE DRAWINGS

FIG. 3A is a top view of the first body sections of one embodiment of my invention.

FIG. 3B is a side view of a single section of the first body section of FIG. 3A.

FIG. 4A is a top view of the sectional second body of one embodiment of my invention.

FIG. 4B is a front view of one tube-half section of the embodiment of FIG. 4A.

FIG. 4C is a side view of the one tube-half section of the embodiment of FIG. 4B.

FIG. 6A is a top view of the sectional ring grill of one embodiment of my invention.

FIG. 6B is a side view of two sections of the embodiment of the ring grill shown in FIG. 6A.

DESCRIPTION OF THE PREFERRED EMBODIMENT OF MY INVENTION

Figure 1:
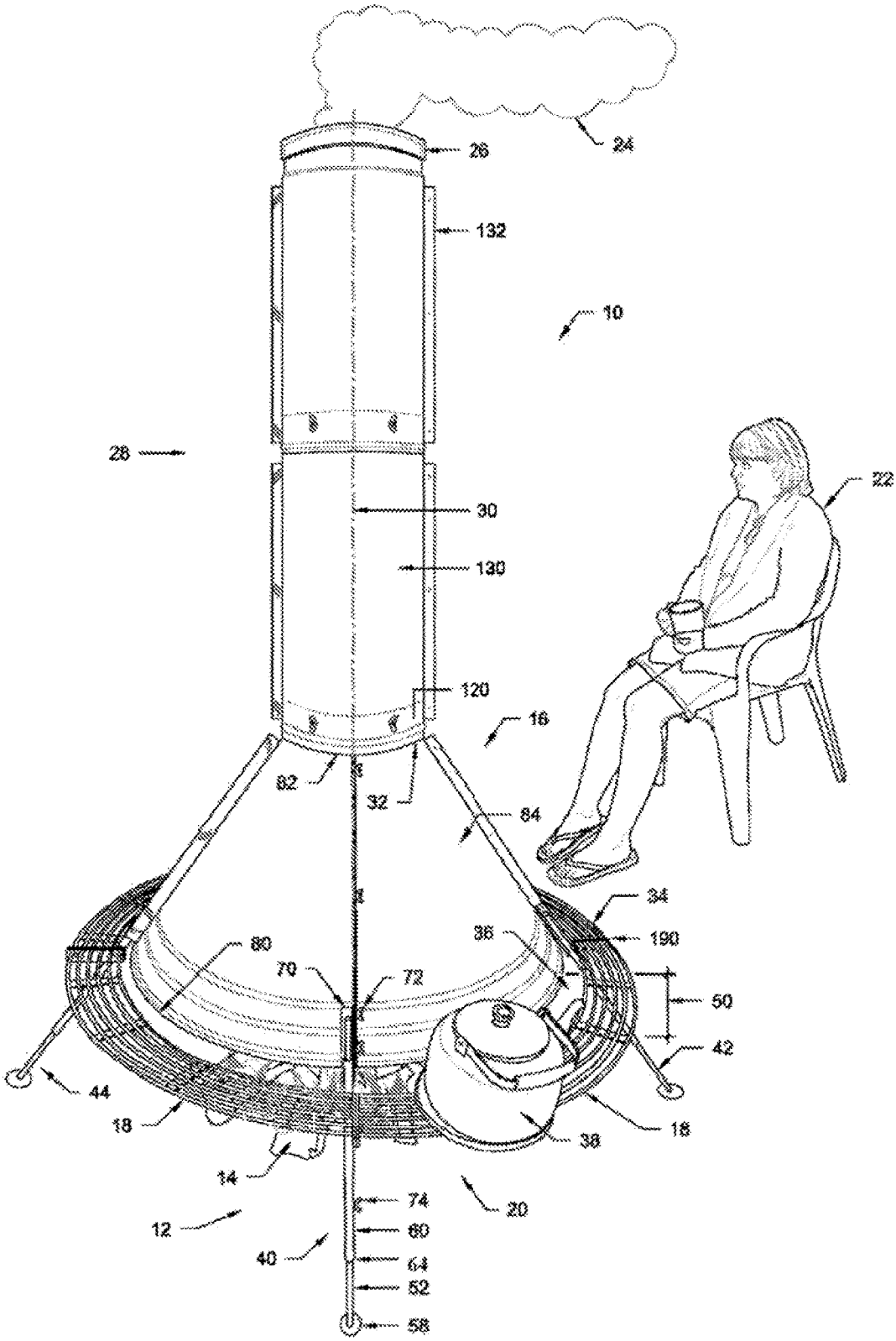
FIG. 1 is an assembled view of one embodiment of my invention.

Referring to FIG. 1, there is shown one embodiment of my invention 10 which is a portable campfire chimney. The chimney comprises base means 12 for supporting the portable chimney 10 over a campfire 14.

The invention may be constructed from light weight sheet metal of a suitable gauge.

The chimney 10 further comprises a first body 16 disposed over the base means 12 and centered above the campfire for creating a draft 18 at the bottom end 20 of the chimney and shielding adjacent persons 22 from combustion products 24 of the campfire 14 which are exhausted from the top end 26 of the chimney.

A second body 28 is disposed axially 30 on the top end 32 of the first body 16 for collecting combustion products 24 from the first body and exhausting them to the atmosphere by way of the top end 26 of the chimney.

In the embodiment shown, there is included an exterior ring-grill 34 disposed radially around the first body 16 and spaced 36 away from the first body for placement of objects 38 thereupon for heating.

Figure 2A:
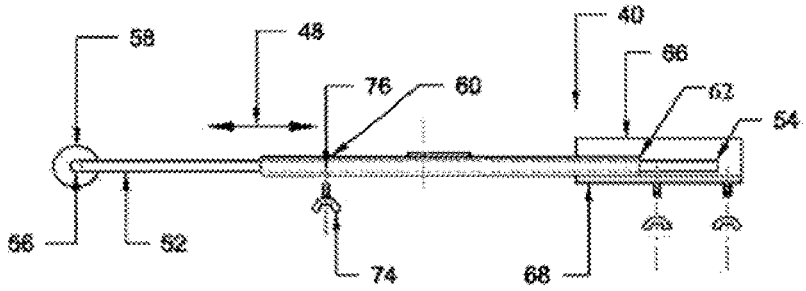
FIGS. 2A to C are front, side and top views respectively of the leg assembly of one embodiment of my invention.
Figure 2C:
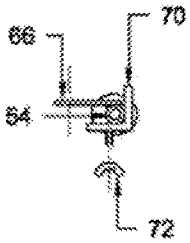
Figure 2B:
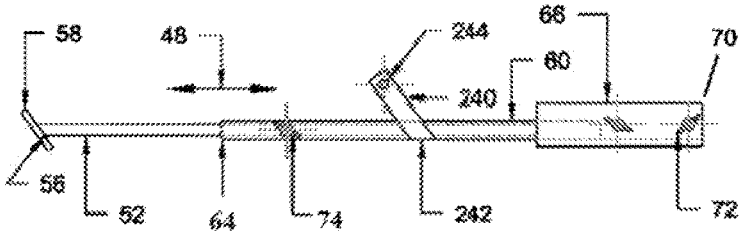

Referring to FIGS. 1 and 2, in which FIG. 2A is a front view of the leg assembly, FIG. 2B is a side view of the leg assembly and FIG. 2C is a top view of the leg assembly, base means 12 comprises at least four detachable leg assemblies 40, 42, 44 and 46 (not shown but opposite assembly 40). The leg assemblies are disposed radially around the first body 16 and detachably attached thereto for maintaining the first body 16 a stable and adjustable distance 50 above the campfire. The detachable leg assemblies (40 to 46) are telescopically 48 adjustable for adjusting distance 50. For example, in windy conditions it may be desirable to keep the first body 16 closer to the fire 14 to prevent the wind from disrupting the blaze. In calmer conditions the chimney can be raised higher above the fire.

Each of the leg assemblies comprises a tubular leg shaft 52 comprising a shaft top end 54 and a shaft bottom end 56. There is a supporting foot member 58 fixed to said leg shaft bottom end for leg support and so that the leg does not sink into soft soil. The leg assembly further includes a leg tube 60 having a tube top end 62 and a tube bottom end 64 for accepting the tubular leg shaft 52 in a sliding relationship. An apertured mounting bracket 66 has a bracket bottom end 68 permanently fixed to the leg tube top end 62 and a bracket top end 70 for detachable attachment by attachment means 72 to the first body 16. Attachment means comprises a threaded member 148 and butterfly nut 72 but can comprise other methods of attachment as understood by a person skilled in the art.

There is also means 74 for temporarily fixing the leg shaft 52 within the leg tube 60 so that telescopic adjustment can be made and fixed so that the desirable distance 50 between the campfire 14 and the chimney bottom 20 can be achieved and maintained. Means 74 is a threaded member with a butterfly head that threads into an aperture 76 in the leg tube 60 and can be tightened against the leg shaft 52.

Referring now to FIG. 1 and FIG. 3, in which FIG. 3A is a top view of the first body in a disassembled view and FIG. 3B is a view of one disassembled section of the first body, the first body 16 comprises a circular open bottom orifice 80 for placement over the campfire 14 and a circular open top orifice 82 for connection to the second body 28. The first body 16 includes a sloping closed side surface 84 between the circular open bottom orifice 80 and the circular open top orifice 82 for shielding persons 22 from the campfire combustion products 24 including excessive heat, ash, smoke and burning embers. The first body 16 forms a frusto-cone for creating a natural draft 18 over the campfire 14.

The first body 16 frusto-cone comprises a plurality of detachable attached sections. In the embodiment illustrated there are four sections numbered 90 to 96 inclusive. Referring to FIG. 3B and illustrated by section 90, each of the detachably attached sections comprises a top edge 92 having an apertured 94 collar piece 96 projecting there from. There is a bottom edge 98, a first side edge 100, a second side edge 102, a surface 104, a plurality of parallel stiffening ridges 106 adjacent to the bottom edge 98. There is further a first side edge flange 108 extending from near the top edge 92 to near the bottom edge 98 and having a first plurality of apertures 110. A second side edge flange 112 extends from near the top edge 92 to near the bottom edge 98 and also has a second plurality of apertures 114 corresponding to the first plurality of apertures 110. Attachment means 72 are included for detachably attaching the first side edge flange 108 to an adjacent second side edge flange 112 so that once the four sections are attached the frusto-conical first body 16 is formed having an apertured circular 120 collar projecting from the top 32 thereof for attachment of the second body 28.

The leg assembly mounting bracket 66 top end 70 is detachable attached by attachment means 72 over the plurality of stiffening ridges 106 and at a point where the first side edge flange 108 joins side edge flange 112 from an adjacent section.

Referring now to FIG. 4 in which FIG. 4A is a top view of a disassembled second body tube, FIG. 4B is a front view of a tube-half and FIG. 4C is a side view of a tube-half, the second body 28 comprises at least one tubular section 130. In the embodiment shown in FIG. 1 there are two tubular sections 130 and 132 in a stacked relationship. Other tubular sections can be added as desired to increase chimney height but not to a point where the chimney becomes unstable. Each tubular section 130 shown in FIG. 4 has an open bottom end 134 for axial 30 mounting to the first body frusto-cone 16 circular collar 120. The collar is apertured 94 and the bottom portion 136 of the tubular section 130 is also apertured 138 so that the collar and bottom portion mount in aperture agreement for attachment by attachment means 72. The tubular section 130 has an open top end 140 for exhausting combustion products 24 or for accepting the bottom end 134 of a second tube 132.

As shown in FIG. 4, each tubular section comprises a first semi-circular half tube 142 detachably attached to a second semi-circular half tube 144. The first and the second semi-circular halve tubes comprise a top end 146 having a collar piece 150 projecting there from. Each collar piece includes two outward protruding threaded members 148 for receiving a butterfly nut 72. There is also a bottom end 134 having at least one stiffening ridge 152 disposed horizontally adjacent to the bottom end 134. Apertures 138 are disposed above the at least one stiffening ridge 152.

Each tube-half 142 and 144 includes a first side edge 154 having an apertured 158 first side edge flange 162 and a second side edge 156 having a second side edge flange 164 with a plurality of threaded members 148 projecting there from. As shown in FIG. 4A, the first 162 and the second 164 apertured side edge flanges of the first semi-circular tube-half 144 can be aligned in threaded-member 148 and aperture 158 agreement with the second 170 and first 172 respective side edge flanges of the second semi-circular tube-half 142 and attached by the attachment means 72 to form a one tubular section 130.

The bottom end 134 of the tubular section 130 is placed over the circular collar 120 in apertured agreement for detachable attachment.

Figure 5A:
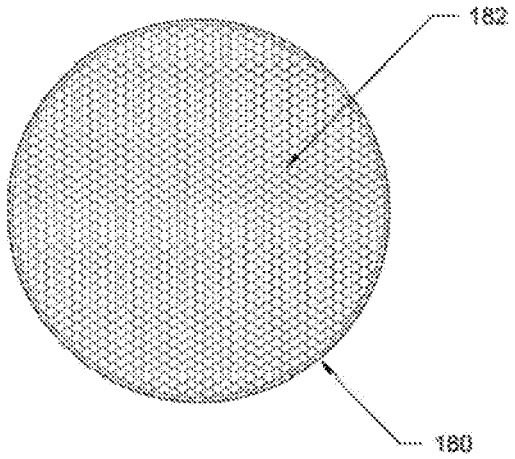
FIG. 5A is a top view of a spark arrestor of one embodiment of my invention.
Figure 5B:
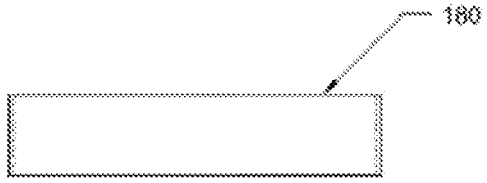
FIG. 5B is a side view of the spark arrestor of the embodiment of FIG. 5A.

Referring to FIG. 5 and FIG. 1, in which FIG. 5A is a top view of a spark arrester 180 and FIG. 5B is a side view of the spark arrester. The top end 140 of the top tubular section 132 is capped with a spark arrestor 180 having a mesh screen 182 to prevent burning sparks and embers from leaving the chimney and starting fires.

Now referring to FIG. 1 and FIG. 6, in which FIG. 6A is a top view of the ring rill in sections and FIG. 6B is a side view of the ring grill in sections, the exterior ring grill 190 comprises four identical connectable ring quarter sections (192 to 198). Sections 198 and 192 are shown in FIG. 6B with section 198 having a first end 200 and a second end 202 and section 192 having a first end 204 and a second end 206. Each section comprises a plurality of concentric support members 208. In the embodiment shown there are five such concentric support members A to E. The support members are disposed horizontally thereby forming a supporting surface 210. The support members have an equal spaced apart relationship. There are at least two support bars 212 and 214 spaced equally between the first end 200 and the second end 202. The support bars are disposed beneath the concentric support members 208 and fixed thereto for support and to maintain the spaced relationship between the rings.

The first end 200 and second end 202 further comprise a first end flange 220 and a second edge flange 222 disposed beneath the supporting surface 210. The first edge flange includes a first 224 and second aperture 226 and the second edge flange comprises a first 228 and second 230 threaded member projecting there from so that when the ring quarter sections are connected, the said first and second threaded members enter the first and second apertures and are detachably attached by attachment means.

Referring to FIG. 2, the exterior ring 190 is further supported by a bracket 240 having a first end 242 fixed to each of the leg tubes 60 and a second end 244 fixed between the second end 202 of, for example, ring section 198 and the second end 204 of ring section 192.

It can be seen for the description of my invention provided herein that my invention has a number of advantages:

- It is manufactured in pieces or sections so that it is easy to assemble and disassemble.
- It is light weight sheet metal and can be easy carried by a single individual.
- It is well suited for commercialization as a kit with accessories such as the ring grill or other attachments for heating food and beverages.
- It has a 360 degree cooking surface that permits cooking on all sides of the chimney.

It includes a spark and ash screen which eliminates fire causing sparks from the chimney exhaust.

It has a sturdy and stable construction which makes it safe for children and adults and prevents people or pets from accidentally stumbling into the fire.

The chimney and its parts are scalable to any size from a small back-packing size to larger sizes for campsite fires.

My invention may have many modifications, variations and accessories which are possible and can be practiced in a manner that is not necessarily describe herein. Thus the scope of the invention should be determined by the appended claims and their legal equivalents rather than by the examples given.

What is claimed is:

1. A portable campfire chimney comprising:

a) at least four telescoping, adjustable and detachable leg assemblies disposed radially around and attached to a sloping closed side of a conical first body for maintaining said conical first body a stable and desirable distance above a campfire;

b) the conical first body comprising:

1) an inverted truncated cone having an open circular base disposed over said at least four telescoping, adjustable and detachable leg assemblies and centered above said campfire and an open truncated top;

2) said sloping closed side surface comprising a first plurality of detachably attached sections for disassembly and storage and for shielding persons from campfire combustion products and creating a natural draft over the campfire;

c) a second tubular body comprising a second plurality of detachably attached sections for disassembly and storage and disposed axially on said open truncated top for collecting said combustion products from the first conical body and exhausting them to the atmosphere; and, d) an exterior ring-grill disposed radially around said open circular base of the first conical body for placement of objects thereupon for heating wherein said exterior ring-grill comprises four identical connectable ring quarter sections having a first end and a second end, comprising a plurality of concentric support members disposed horizontally thereby forming a supporting surface and having an equally spaced apart relationship, at least two support bars spaced equally between said first end and said second end and disposed beneath said plurality of concentric support members and fixed thereto for support of said supporting surface and maintaining said spaced apart relationship of said plurality of concentric rings.

2. The portable campfire chimney of claim 1, wherein said first end and said second end comprise a first end flange and a second edge flange disposed beneath said supporting surface, and wherein said first edge flange includes a first and second aperture and said second edge flange comprises a first and second threaded member projecting there from so that when said ring quarter sections are connected, the said first and second threaded members enter said first and second apertures and are detachably attached by a threaded member and nut assembly.

3. The chimney of claim 2, wherein the exterior ring is further supported by a bracket having a first end fixed to each of said leg tubes and a second end fixed between the first end and the second end of the ring members.

4. The chimney of claim 1, wherein said first plurality of detachably attached sections comprises four sections, and wherein each section of said four sections comprises:

a) A top edge having an apertured collar piece projecting there from, b) A bottom edge, c) A first side edge, d) A second side edge, e) A surface, f) A plurality of parallel stiffening ridges adjacent to said bottom edge;

g) A first side edge flange extending from said top edge to the bottom edge, and having a first plurality of apertures;

h) A second side edge flange extending from the top edge to the bottom edge, and having a second plurality of apertures corresponding to said first plurality of apertures; and, i) Said threaded member and nut assembly for detachably attaching said first side edge flange to an adjacent second side edge flange so that once the four sections are attached the conical first body is formed having an apertured circular collar projecting from the top thereof for attachment of the tubular second body.

* * * * *